US007578905B2

(12) United States Patent
Lundberg et al.

(10) Patent No.: US 7,578,905 B2
(45) Date of Patent: Aug. 25, 2009

(54) METHOD AND APPARATUS FOR TRANSVERSE DISTRIBUTION OF A FLOWING MEDIUM

(75) Inventors: Jörgen Lundberg, Sundsvall (SE); Olof Melander, Sundsvall (SE)

(73) Assignee: Metso Paper, Inc. (FI)

( * ) Notice: Subject to any disclaimer, the term of this patent is extended or adjusted under 35 U.S.C. 154(b) by 359 days.

(21) Appl. No.: 10/585,753

(22) PCT Filed: Jan. 13, 2005

(86) PCT No.: PCT/SE2005/000027

§ 371 (c)(1),
(2), (4) Date: Jul. 12, 2006

(87) PCT Pub. No.: WO2005/068850

PCT Pub. Date: Jul. 28, 2005

(65) Prior Publication Data

US 2007/0163739 A1 Jul. 19, 2007

(30) Foreign Application Priority Data

Jan. 16, 2004 (SE) ..... 0400085

(51) Int. Cl.
*D21F 1/06* (2006.01)

(52) U.S. Cl. ..... 162/212; 162/336

(58) Field of Classification Search ..... 162/212, 162/213, 216, 315, 336, 338, 343, 344, 347
See application file for complete search history.

(56) References Cited

U.S. PATENT DOCUMENTS 2,865,260 A 12/1958 Lee et al.
3,772,144 A 11/1973 Luthi et al.
3,937,273 A * 2/1976 Radvan et al. ..... 162/212
3,980,518 A 9/1976 Ljung et al.
4,021,296 A * 5/1977 Reiner ..... 162/214
4,085,003 A 4/1978 Luthi
4,098,642 A 7/1978 Luthi
4,280,870 A * 7/1981 Bubik et al. ..... 162/336
4,593,436 A 6/1986 Burgess et al.
5,019,215 A 5/1991 Fortier et al.
5,571,383 A * 11/1996 Fredriksson et al. ..... 162/213
6,372,092 B1 * 4/2002 Bubik et al. ..... 162/344
7,311,803 B2 * 12/2007 Danielsson et al. ..... 162/213

FOREIGN PATENT DOCUMENTS

WO WO-94/10380 A 5/1994

* cited by examiner

*Primary Examiner*—Eric Hug
(74) *Attorney, Agent, or Firm*—Lerner, David, Littenberg, Krumholz & Mentlik, LLP

(57) ABSTRACT

Methods for achieving even transverse distribution and propagation of a flowing medium are disclosed in which the flowing medium is supplied through a conduit and is deflected during diverging propagation in at least one distribution gap.

The method includes deflecting the flowing medium during diverging propagation along the distribution gap in which the medium is conveyed through a passage to an outlet gap having a larger depth than the depth of the distribution gap. The medium is conveyed over an edge of the passage extending transverse to the direction of the flow, and the edge is designed to obtain a propagation along the flowing path of the diverging medium that provides a substantially even and parallel flow of the medium along the outlet gap. Apparatus for achieving this method is also disclosed.

12 Claims, 4 Drawing Sheets

METHOD AND APPARATUS FOR TRANSVERSE DISTRIBUTION OF A FLOWING MEDIUM

FIELD OF THE INVENTION

The present invention relates to a method and apparatus for achieving even transverse distribution and propagation of a flowing medium.

BACKGROUND OF THE INVENTION

In the cellulose and paper industries, for example, it is necessary to be able to form webs of fiber suspensions in an even and wide distributed flow in the transverse and longitudinal directions on a base, such as a roll, drum or the like. An uneven formation may thus result in an impaired pulp quality, for example due to fiber damages at subsequent press nips in thicker formed sections, canalization of the washing liquid, and poor efficiency during displacement washing.

Distribution of the flow of the flowing medium is controlled substantially by frictional losses (i.e. pressure drop) when the medium flows through a distributor. In order to ensure an even distribution, propagation and discharge of the medium in the transverse direction along a long and narrow gap, e.g. in a rectangular shaped distribution section, which is often desired, any of the following two principles mentioned can be applied:

Design the distributor such that the pressure drop along each streamline, for an evenly distributed outlet flow, from the inlet to the outlet, become essentially the same.

Provide a large pressure drop at the outlet of the distributor such that the differences in friction losses along different streamlines become negligible compared to the outlet friction losses.

One problem in applying the first principle (1) above is that the variation in velocity along individual streamlines of the flowing medium is hard to predict. This fact in combination with limited knowledge about the boundary layer behavior of e.g. suspensions of wood fibers, makes it difficult to predict the pressure drop along the streamlines. One problem is clogging of the distributor when the fibers tend to slow down or adhere to the inner faces of the distributor which influences the runnability. Known distributors have also been shown to be sensitive to variations in the flow velocity.

One object of the present invention is to provide a method and an apparatus according to the first principle, where an improved propagation and distribution of a flowing medium is accomplished and where the above mentioned problems are minimized.

SUMMARY OF THE INVENTION

This and other objects of the present invention have now been realized by the discovery of a method for obtaining an even transverse distribution and propagation of a flowing medium supplied through a conduit, the method comprising deflecting the flowing medium during diverging propagation of the flowing medium along at least one distribution gap having a frictional surface and a first depth, and conveying the flowing medium from the at least one distribution gap to an outlet gap having a second depth, the second depth being greater than the first depth, through a passage having an edge extending substantially transverse to the direction of flow of the flowing medium, the edge being shaped such that the propagation of the flowing medium as it flows within the distribution gap provides a substantially even and parallel flow of the flowing medium along the outlet gap. In a preferred embodiment, the method includes deflecting the flowing medium by diverging propagation along a plurality of the distribution gaps, each of the plurality of distribution gaps having a different depth. Preferably, the plurality of distribution gaps has a depth in the range of 8 to 60 mm.

In accordance with one embodiment of the method of the present invention, the second depth is from 1.2 to 4 times the first depth.

In accordance with another embodiment of the method of the present invention, the at least one distribution gap includes at least two diverging frictional surfaces interconnected by an edge shaped in the form of a circular arc.

In accordance with another embodiment of the method of the present invention, the method includes conveying the flowing medium so as to propagate the flowing medium in a rectangular cross-sectional shape. In accordance with another embodiment of the method of the present invention, the method includes redirecting the conveying of the flowing medium in at least one curved section.

In accordance with the present invention, the above and other objects have also been realized by the discovery of a distributor for the even transverse distribution and propagation of a flowing medium comprising a distribution housing including a supply conduit for supply of the flowing medium and at least one distribution gap having a frictional surface and a first depth for deflecting the flowing medium during the propagation, the distribution gap having a diverging shape for propagation of the flowing medium, and an outlet gap having a second depth for passage of the flowing medium after passage through the distribution gap, the second depth being greater than the first depth, and the distribution housing further comprising a passage between the distribution gap and the outlet gap, the passage comprising an edge extending substantially transverse to the direction of flow of the flowing medium, the edge being shaped such that the propagation of the flowing medium as it flows within the distribution gap provides a substantially even and parallel flow of the flowing medium along the outlet gap. In a preferred embodiment, the distributor comprises a plurality of the distribution gaps, each of the plurality of distribution gaps having a different depth.

In accordance with one embodiment of the distributor of the present invention, the plurality of distribution gaps has a depth in the range of 8 to 60 mm.

In accordance with another embodiment of the distributor of the present invention, the second depth is from 1.2 to 4 times the first depth.

In accordance with another embodiment of the distributor of the present invention, the at least one distribution gap has a substantially rectangular cross-sectional shape.

In accordance with another embodiment of the distributor of the present invention, the at least one distribution gap comprises at least two diverging frictional surfaces interconnected by an edge in the shape of a circular arc.

In accordance with another embodiment of the distributor of the present invention, the distributor includes at least one curved section for redirecting the flow of the flowing medium from the supply conduit to the outlet gap.

The objects of the present invention are achieved by a method for obtaining even transverse distribution and propagation of a flowing medium where: the medium is supplied through a conduit and is deflected during propagation in at least one distribution gap defined by a frictional surface; the medium is deflected during diverging propagation along the distribution gap; the medium is conveyed from the distribution gap through a passage to an outlet gap having a larger column depth than the depth of the distribution gap; the medium is conveyed over an edge, that constitutes a passage to the outlet gap, extending substantially transverse to the direction of flow; and the edge is shaped such that the frictional surface obtains propagation along the flowing path of the diverging medium in the distribution gap that provides a substantially even and parallel flow of the flowing medium along the outlet gap.

In that respect, frictional losses, in accordance with the present invention, for an evenly distributed outlet flow, become essentially similar for all streamlines. The shape of the edge is intended to vary the quantity of frictional surface along different streamlines in the distribution gap, in order to therefore provide an evenly distributed flow out of the outlet gap. Owing to the increase of the cross-section of the outlet gap during passage of the edge that extends substantially in the transverse direction, the pressure drop per unit of length along a streamline decreases, which causes the shaping of the outlet gap to become of reduced significance, in relation to other parts of the apparatus.

By "medium" in this description is meant liquids, gases, foam, fiber suspensions or other mixture of substances.

After passage through the gaps, the flowing medium passes an outlet opening. Preferably, the outlet opening is preceded by several distribution gaps having different column depths for the purpose of controlling frictional losses in different parts of the machine.

An outlet gap may suitably have a column depth at the outlet opening that is in the size of 1.2 to 4 times the column depth of the preceding gap.

By "frictional surface" in this description is meant those surfaces with which the flowing medium is in contact. It is the quantity of frictional surface in the distribution gap, alternatively the distribution gaps, and not the outlet gap, that controls the profile of the flow. The shape of the edge may compensate for frictional losses in the outlet gap.

In accordance with the present invention, a distributor has been discovered for the even transverse distribution and propagation of a flowing medium. The distributor comprises a distribution housing with a conduit for supply of the medium and deflection during propagation in at least one distribution gap arranged in the distributor defined by a frictional surface. The distribution housing comprises an outlet opening through which the medium passes after its passage through the distributor. The distribution gap is shaped with a diverging propagation. The distribution housing comprises a passage between the distribution gap and an outlet gap which is arranged with a larger column depth than the depth of the distribution gap. The passage comprises an edge, extending substantially transverse to the direction of flow, and which constitutes a passage to the outlet gap. The edge is shaped such that the frictional surface obtains a propagation along the flowing path of the diverging medium in the distribution gap that provides a substantially even and parallel flow of the flowing medium along the outlet gap.

BRIEF DESCRIPTION OF THE DRAWINGS

The present invention will now be described in more detail with reference to the following detailed description, which in turn refers to the accompanying drawings, without limiting the interpretation of the invention thereto, where.

DETAILED DESCRIPTION

Figure 1A:
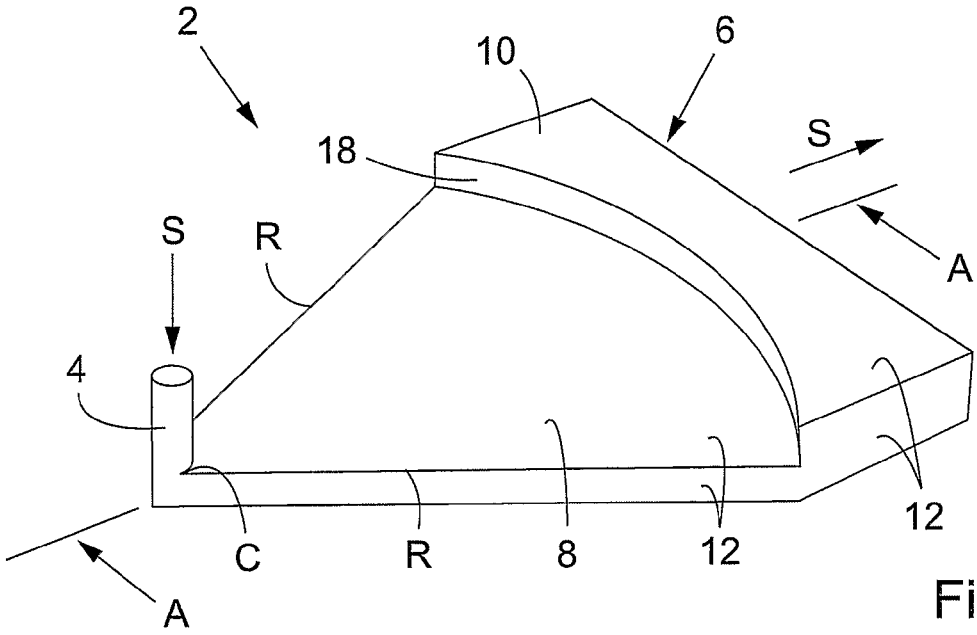
FIG. 1A is a perspective, schematic, top view of a distributor according to an embodiment of the present invention.
Figure 1B:
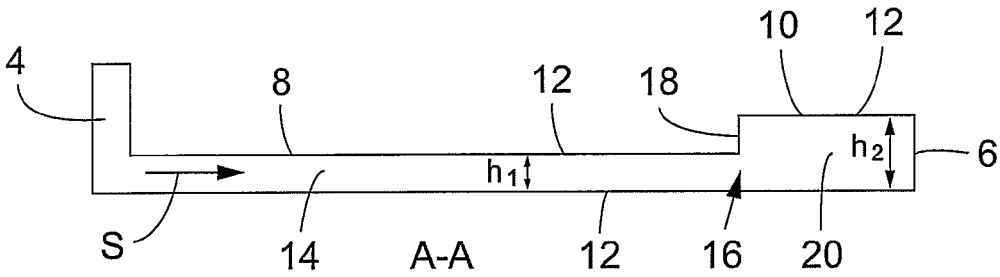
FIG. 1B is a side, elevational, cross-sectional view taken along section A-A of the distributor shown in FIG. 1A.

Turning to the figures, FIGS. 1A and 1B show a distributor according to an embodiment of the present invention for even, transverse distribution and propagation of a flowing medium. The distributor comprises a distribution housing 2 with a conduit 4 for supply of the medium and a wide outlet opening 6. The distribution housing is shaped with a distribution chamber 8 and an outlet chamber 10, which chambers are formed by limiting surfaces 12, whose inner faces are denoted as frictional surfaces. The supply conduit 4 in FIG. 1 is arranged at an angle to the distribution chamber 8, but may also be arranged in parallel to the direction of the flow S. The distribution chamber 8 has a distribution gap 14 that extends from the connection of the conduit in a diverging, conical propagation to a passage 16 having an edge 18, extending substantially transverse to the direction of the flow, with a radius of curvature R, which edge 18 e.g. has the shape of an arc, at which passage 16 the outlet chamber 10 is connected. The distribution gap 14 of the distribution chamber communicates through the passage 16 with an outlet gap 20 of the outlet chamber, which outlet chamber 20 is arranged with a larger column depth than the depth of the distribution gap 14 of the distribution housing 2, which outlet gap 20 extends from the passage 16 to the rectangular outlet opening 6. Both gaps, 14 and 20, have a substantially rectangular cross-section. The pressure drop along each streamline, from the supply through the conduit 4 to a discharge of the output flow of the medium through the outlet opening 6, for an evenly distributed outlet flow, is essentially the same, providing a substantially even and parallel outlet flow.

Since the distance along each streamline is not equal in the outlet chamber 10, the pressure drop in this chamber shall be relatively small in comparison to the pressure drop in other parts of the apparatus.

The supply conduit 4 can be arranged in the vicinity of the intersecting line C for the diverging, limiting surfaces. Preferably, the distribution chamber 8, from the inlet forward to the edge extending essentially in the transverse direction, is provided with two diverging limiting surfaces, which are preferably interconnected by an edge 18 shaped as a circular arc.

According to one embodiment of the present invention, the passage between the distribution channel 8 and the outlet chamber 10 can be provided with sections of a plurality of distribution gaps, having different column depths, which is described more closely below with reference to FIG. 5. Thus; the number of gaps with different column depths can be more than two, suitably three or four, and the passage between two or a plurality of gaps may be provided by an edge shaped in a similar way as the edge 18 described herein. The distribution gaps may have increasing column depths along the direction of the flow. However, according to a preferred embodiment, the distributor according to the present invention comprises alternating increasing and decreasing column depths of the distribution gaps.

The purpose of arranging a plurality of gaps is to be able to control frictional losses in different parts of the machine. The gaps may have a column depth in the range of 8 to 60 mm.

An outlet gap at the outlet opening 6 can have a column depth ($h_2$) that is in the size of 1.2 to 4 times the column depth ($h_1$) of the preceding gap, and preferably 1.5 to 4 times the column depth ($h_1$) of the preceding gap.

The same reference numerals are used in the drawings to the extent that details in the different embodiments are in correspondence.

FIGS. 2A-D show variations of the shape of the edge 18 and illustrate how the flow picture is altered when changing the curvature of an arc-formed edge.

Figures 2A, 2B, 2C, 2D:
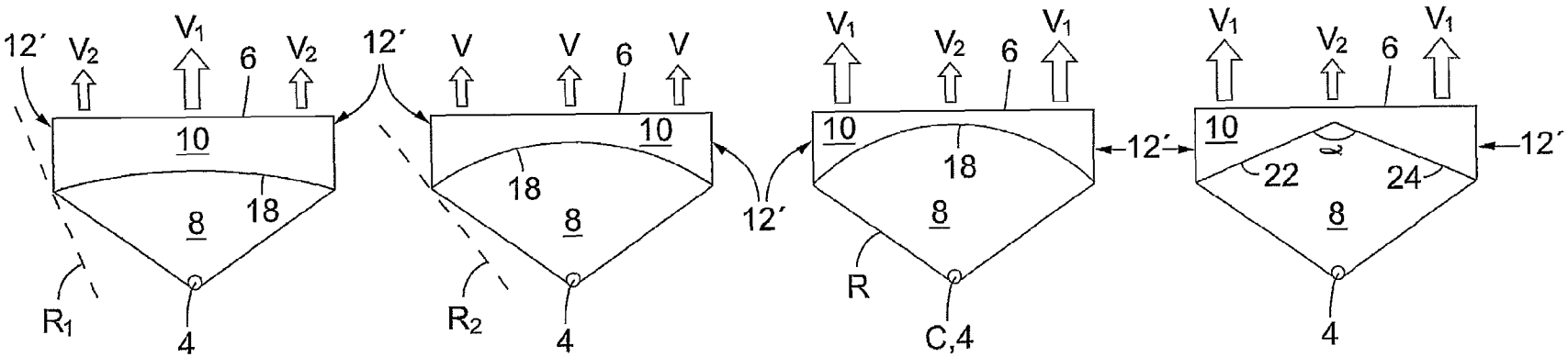
FIG. 2A is a top, elevational, partially schematic view of an edge of the distributor according to the present invention, showing the effect on the flow distribution out of the distributor.
FIG. 2B is a top, elevational, partially schematic view of an edge of another distributor according to the present invention, showing the effect on the flow distribution out of the distributor.
FIG. 2C is a top, elevational, partially schematic view of an edge of another distributor according to the present invention, showing the effect of the flow distribution out of the distributor.
FIG. 2D is a top, elevational, partially schematic view of an edge of another distributor according to the present invention, showing the effect on the flow distribution out of the distributor.

According to one embodiment, the edge 18 may have a substantially circular arc-formed extension with a radius of curvature R, which radius may have a different curvature for different embodiments of distributors, such as for example is shown in FIGS. 2A-C. The supply conduit 4 can be arranged in a center on a chord of the circular arc. Preferably, the distributor chamber 8, from the inlet forward to the circular arc of the apparatus, is substantially cone-shaped. This section may form a sector of a circle. FIG. 2C shows an embodiment of the circular arc where all radii R of the sector of the circle converge in one central point C (see also FIG. 1A). In this way it is also ensured that the path each streamline follows from the inlet forward to the circular arc is equally long. Then the supply conduit 4 is placed in the central point C. The radius of curvature R of the circular arc may be larger than what is shown in FIG. 2C, such as is evident from FIGS. 2A and 2B. A shape according to FIG. 2B is assumed to produce an evenly distributed flow V along the entire outlet opening 6, there will be a change to a shallower circular arc, i.e. having a larger radius of curvature $R_1$ than the shape of the edge with the radius of curvature $R_2$ in FIG. 2B, resulting in a larger flow $V_1$ in the middle of the outlet opening and a smaller flow $V_2$ against the side edges 12' of the outlet opening, in comparison to that of FIG. 2B. If, instead, in comparison with FIG. 2B, a deeper circular arc is provided, i.e. one having a smaller radius of curvature R than the shape of the edge having the radius of curvature $R_2$ in FIG. 2B, this results in a lower flow $V_2$ in the middle of the outlet opening and a larger flow $V_1$ at the side edges 12' of the outlet opening in comparison to the shaping according to FIG. 2B.

In FIG. 2D is shown an embodiment of another shape of the edge 18, in this case made of two essentially straight edge sections, 22 and 24, that meet at a point near the middle of the outlet opening 6. The edge sections, 22 and 24, form an angle $\alpha$ between them. The flow picture for the embodiment shown in FIG. 2D is similar to that of FIG. 2C, i.e. the flow $V_1$ is largest at the side edges 12' of the outlet opening and lower $V_2$ in the middle of the outlet opening in comparison to the shaping according to FIG. 2B. The edge may also be provided with other angles between the straight sections of the edges, 22 and 24, depending on which flow picture is desired along the outlet opening. The edge 18 may also be provided with more than two edge sections (not shown).

Figure 3:
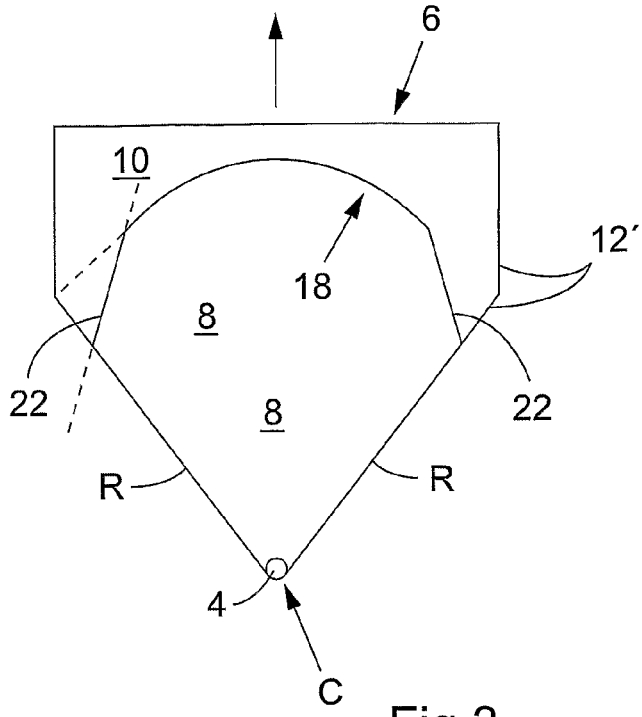
FIG. 3 is a top, elevational, partially schematic view of another embodiment of a distributor according to the present invention.

In FIG. 3 is shown another embodiment according to the present invention. By an essentially circular arc-formed edge 18 it is meant that sections of the edge 18 may have differing shapes, but that the passage between the distribution gap 14 and the outlet gap 20 mainly follows the shape of a circular arc. For instance, the circular arc may terminate against the respective side edges 12' of the apparatus with straight sections 22, which sections substantially extends parallel with the side edges 12' of the outlet chamber. The circular arc may thus be shortened against the side edges 12' in order to compensate for increasing frictional losses at the edges 12'.

Figure 4A:
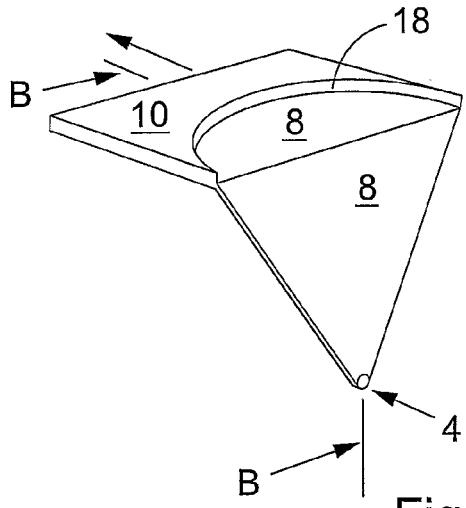
FIG. 4A is a side, perspective view of yet another embodiment of a distributor according to the present invention.
Figure 4B:
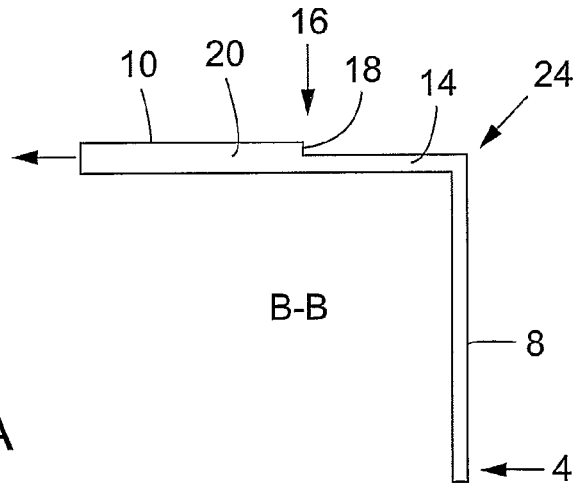
FIG. 4B is a side, elevational, cross-sectional view taken along section A-A of the distributor shown in FIG. 4A.

According to the present invention, the flow moves through a channel extending substantially in a plane. For that reason, redirection of the flow is minimized, whereby problems with clogging can be minimized. According to yet one embodiment according to the present invention, as evident from FIGS. 4A-B, the apparatus may nevertheless comprise at least one redirection 24, such as a curved section or the like. The pressure drop in consequence of the redirection is negligible. This design can be preferred for technical assembly reasons.

Figure 5:
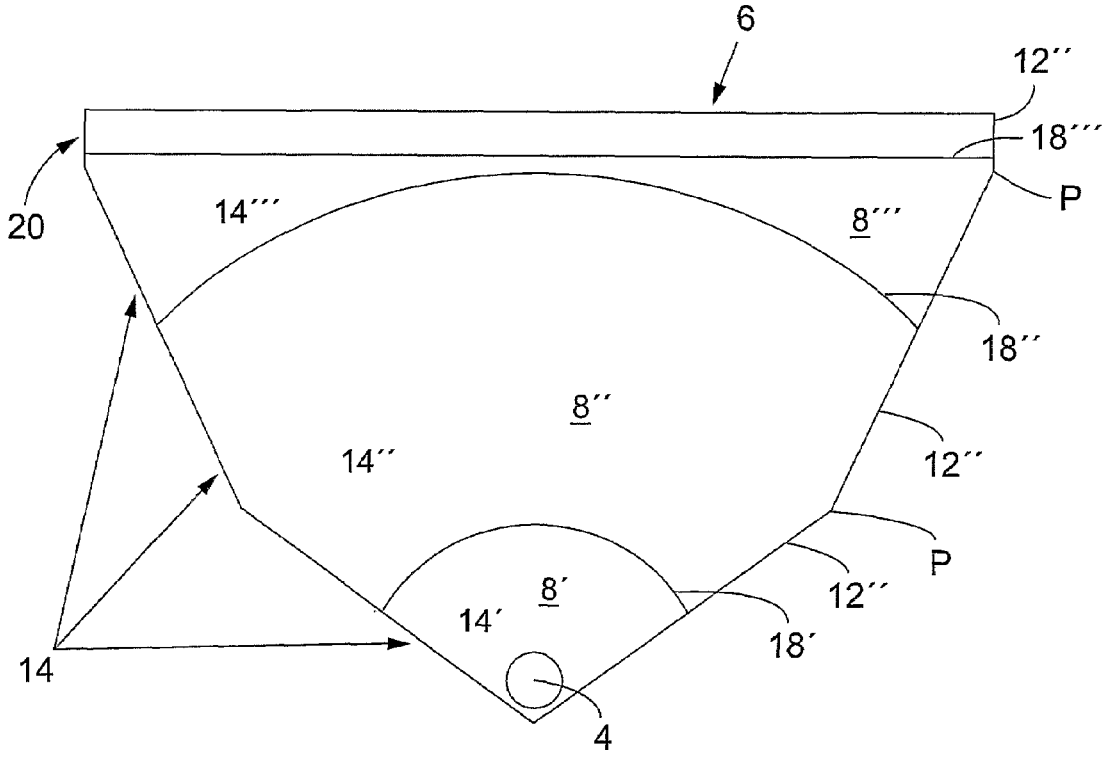
FIG. 5 is a top, elevational, partially schematic view of yet another embodiment of a distributor according to the present invention.

FIG. 5 shows a preferred embodiment according to the present invention, where the distributor comprises a first distribution gap 14', a second distribution gap 14", a third distribution gap 14'" and an outlet gap 20. The first distribution gap 14' is arranged from the inlet forward to a first circular arc-shaped edge 18' that interconnects two diverging limiting surfaces that constitutes a first distribution chamber 8'. The second distribution gap 14" is arranged from the first circular arc-shaped edge 18' forward to a second circular arc-shaped edge 18" that interconnects two diverging limiting surfaces that constitutes a second distribution chamber 8". The third distribution gap 14'" is arranged from the second circular arc-shaped edge 18" forward to an edge 18'" extending essentially linearly in the transverse direction, that interconnects two substantially diverging limiting surfaces that constitutes a third distribution chamber 8'". The edge extending in the transverse direction constitutes the passage to the outlet gap 20. Sections of the side edges 12" of the gaps 14', 14", 14'" and 20 are angled in the broken points P at the second distribution gap 14" and at the third distribution gap 14'". The second distribution gap 14" preferably has a lower column depth than the first distribution gap 14'. The third distribution gap 14'" preferably has an equal column depth as the first distribution gap 14'. The outlet gap 20 has preferably a larger column depth than the third distribution gap 14".

With reference now to the FIGS. 1-5, a fiber suspension having a concentration of e.g. up to 12% may thus be supplied to the distribution housing 2 through the supply conduit 4. The fiber suspension that enters the distribution chamber, 8, 8', hits the inner limiting surfaces 12 of the housing and is thereby deflected. The suspension is spread from the inlet by decreasing speed outwardly in the distribution gap, 14, 14', in the diverging distribution chamber, 8, 8', to the passage 16 where it once more is deflected when it passes the edge, 18, 18', of a preferred circular arc-shape and passes into the outlet gap 20 having a larger column depth, alternatively passes into yet another distribution gap 14" having a preferred lower column depth and thereafter a distribution gap having a higher column depth than the preceding gap before the outlet gap 20 as described with reference to FIG. 5. After the suspension has been conveyed into the outlet chamber 10, the suspension is forced against the outlet opening 6 to flow in an even substantial parallel flow with a constant velocity.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for obtaining an even transverse distribution and propagation of a flowing medium supplied through a conduit, said method comprising deflecting said flowing medium during diverging propagation of said flowing medium along at least one distribution gap having a first end and a second end, said diverging propagation comprising diverging said flowing medium from said first end corresponding to said conduit conically outwardly to said second end, said at least one distribution gap having a frictional surface and a first depth, and conveying said flowing medium from said at least one distribution gap to an outlet gap having a second depth, said second depth being from 1.2 to 4 times greater than said first depth, through a passage having an edge extending substantially transverse to the direction of flow of said flowing medium, said edge corresponding to said second end of said at least one distribution gap and being shaped in the form of a circular arc such that the propagation of said flowing medium as it flows within said distribution gap provides a substantially even and parallel flow of said flowing medium along said outlet gap.

2. The method of claim 1 including deflecting said flowing medium by diverging propagation along a plurality of said distribution gaps, each of said plurality of distribution gaps having a different depth.

3. The method of claim 2 wherein said plurality of said distribution gaps has a depth in the range of 8 to 60 mm.

4. The method of claim 1 wherein said at least one distribution gap includes at least two diverging frictional surfaces interconnected by said edge.

5. The method of claim 1 including conveying said flowing medium so as to propagate said flowing medium in a rectangular cross-sectional shape.

6. The method of claim 1 including redirecting said conveying of said flowing medium in at least one curved section.

7. A distributor for the even transverse distribution and propagation of a flowing medium comprising a distribution housing including a supply conduit for supply of said flowing medium and at least one distribution gap having a frictional surface and a first depth for deflecting said flowing medium during said propagation, said at leas one distribution gap having a first end corresponding to said supply conduit and a second end whereby said at least one distribution gap diverges conically from said first end outwardly to said second end, for propagation of said flowing medium, and an outlet gap having a second depth for passage of said flowing medium after passage through said at least one distribution gap, said second depth being from 1.2 to 4 times greater than said first depth, and said distribution housing further comprising a passage between said at least one distribution gap and said outlet gap, said passage comprising an edge extending substantially transverse to the direction of flow of said flowing medium, said edge corresponding to said second end of said at least one distribution gap and being shaped in the form of a circular arc such that the propagation of said flowing medium as it flows within said at least one distribution gap provides a substantially even and parallel flow of said flowing medium along said outlet gap.

8. The distributor according to claim 7 comprising a plurality of said distribution gaps, each of said plurality of distribution gaps having a different depth.

9. The distributor of claim 7 wherein said plurality of distribution gaps has a depth in the range of 8 to 60 mm.

10. The distributor of claim 7 wherein said at least one distribution gap has a substantially rectangular cross-sectional shape.

11. The distributor of claim 7 wherein said at least one distribution gap comprises at least two diverging frictional surfaces interconnected by said edge.

12. The distributor of claim 7 including at least one curved section for redirecting the flow of said flowing medium from said supply conduit to said outlet gap.

* * * * *

UNITED STATES PATENT AND TRADEMARK OFFICE

CERTIFICATE OF CORRECTION

PATENT NO. : 7,578,905 B2
APPLICATION NO. : 10/585753
DATED : August 25, 2009
INVENTOR(S) : Jörgen Lundberg and Olof Melander It is certified that error appears in the above-identified patent and that said Letters Patent is hereby corrected as shown below:

In column 8, line 9, "leas" should read --least--.

Signed and Sealed this

Fifth Day of October, 2010

David J. Kappos

David J. Kappos
*Director of the United States Patent and Trademark Office*